US005630466A

United States Patent [19]

Garat et al.

[11] Patent Number: 5,630,466

[45] Date of Patent: May 20, 1997

[54] PROCESS FOR SHAPING METAL MATERIALS IN A SEMI-SOLID STATE

[75] Inventors: Michel Garat, Saint Quentin sur Isere; Willem Loue, Chirens, both of France

[73] Assignee: Aluminium Pechiney, Courbevoie, France

[21] Appl. No.: 501,030

[22] PCT Filed: Jan. 13, 1995

[86] PCT No.: PCT/FR95/00042

§ 371 Date: Aug. 14, 1995

§ 102(e) Date: Aug. 14, 1995

[87] PCT Pub. No.: WO95/19237

PCT Pub. Date: Jul. 20, 1995

[30] Foreign Application Priority Data

Jan. 17, 1994 [FR] France ..... 94 00610

[51] Int. Cl.[6] ..... B22D 17/08; B22D 17/32; B22D 23/00

[52] U.S. Cl. ..... 164/457; 164/71.1; 164/113; 164/900

[58] Field of Search ..... 164/71.1, 900, 164/4.1, 457, 113

[56] References Cited

U.S. PATENT DOCUMENTS

| | | | |
|---|---|---|---|
| 4,494,461 | 1/1985 | Pryor et al. | 164/900 X |
| 4,569,218 | 2/1986 | Baker et al. | 164/900 X |
| 5,040,589 | 8/1991 | Bradley et al. | 164/900 X |
| 5,394,931 | 3/1995 | Shiina et al. | 164/900 X |

FOREIGN PATENT DOCUMENTS

| | | | |
|---|---|---|---|
| 2141979 | 1/1973 | France . | |
| 3-221253 | 9/1991 | Japan | 164/900 |
| WO92/13662 | 8/1992 | WIPO . | |

OTHER PUBLICATIONS

Patent Abstracts of Japan vol. 18, No. 23 (M–1541) 14. Jan. 1994 & JP 5–261 503 (Honda Motor Co. Ltd) Published Oct 12, 1993.

Renzo Moschini "Manufacture of Automotive Components by Semi–Liquid Process", Metallurgical Science and Technology, vol. 9 (3), Dec. 1996.

*Primary Examiner*—J. Reed Batten, Jr.

*Attorney, Agent, or Firm*—Dennison, Meserole, Pollack & Scheiner

[57] ABSTRACT

A blank is prepared of a thixotropic metal material and the blank is reheated to a semi-solid state to obtained a liquid fraction corresponding to a desired viscosity for shaping, while determining the power used in the reheating. The reheated blank is transferred to a forging press including a forging stamp or to a pressure die casting machine including an injection plunger. The resistance of the material to the forging stamp or the injection plunger is determined and defined as a set point value and the blank is shaped by the forging stamp or pressure die casting machine. A subsequent blank of the thixotropic metal material is shaped by the forging press or the pressure die casting machine, and the power used in reheating is regulated to maintain the resistance at the set point value.

8 Claims, No Drawings

PROCESS FOR SHAPING METAL MATERIALS IN A SEMI-SOLID STATE

FIELD OF THE INVENTION

The invention relates to a process for shaping metal materials in a semi-solid state by means of pressure die casting or forging.

DESCRIPTION OF RELATED ART

The shaping of thixotropic metal products, particularly alloys containing iron, copper or aluminum, in a semi-solid state has been known for about twenty years. French Patent 2141979, corresponding to U.S. Pat. No. 3,948,650 to MIT, was the first to describe a process for casting thixotropic metal, the process consisting of raising the temperature of the alloy until it attained a liquid state, cooling to bring about partial solidification, and vigorously agitating the liquid-solid mixture in order to break up the dendrites and transform them into roughly spherical globules in at least ⅔ of the initial composition.

Thixotropic metal reheated to a semi-solid state handles like a solid during its reheating and its transfer to the shaping machine, but behaves like a homogeneous viscous liquid during shaping.

The processes for manufacturing articles in a semi-solid state have advantages over the standard processes: lower shaping energy and faster cooling, which results in reduced shrinkage, higher rates of production, and less wear and tear on tools and dies. These processes generally include the following steps:

- production of billets or ingots of a thixotropic metal or alloy with a primary phase of partially or totally globular structure, by means of mechanical or electromagnetic stirring.
- cutting of blanks which correspond in weight to the metal used in each production cycle in making the articles;
- reheating of the blank until the liquid fraction is attained which corresponds to the desired viscosity. This reheating can be achieved by means of radiation or induction;
- transfer of the reheated metal to the shaping equipment (forging press or pressure die casting machine);
- shaping of the article to be produced.

The viscosity of the reheated metal in a semi-solid state is one of the critical points of the process. If the metal has a viscosity which is too high, it does not flow like a homogeneous liquid during the shaping, and the articles produced have internal defects. If, on the contrary, the viscosity is too low, the blank can no longer be handled like a solid, part of the metal runs off and is lost, and the feeding of the shaping machine is disturbed.

Viscosity in the semi-solid state depends on several parameters:

a) The degree of globularity in the primary phase. The closer this structure gets to the ideal globular structure in which all the dendrites have degenerated into perfectly spherical globules, the more the viscosity decreases;

b) the liquid fraction attained in reheating. The more this is increased, the more the viscosity decreases;

c) the shearing speed of the shaping process. The more this speed is increased, the more the viscosity decreases.

The shearing speed is generally imposed by the shaping machine and by the geometry of the article, so that the desired viscosity must be obtained by means of an adequate combination of the degree of globularity and the liquid fraction.

On the other hand, this viscosity must be reproducible from one shaping cycle to the next, so as to guarantee the reproducibility of the article itself, and thus its quality.

The reheating of the blank plays a decisive role in this reproducibility insofar as it conditions both the liquid fraction proportion and the degree of globularity of the solid fraction during the maintenance of the semi-solid state, as shown in the thesis by W. Loue, entitled "Evolution microstructurale et comportement rhéologique d'alliages aluminium-silicium à l'état semi-solide"["Microstructural evolution and rheological properties of aluminum-silicon alloys in a semi-solid state"], National Polytechnic Institute of Grenoble, October, 1992.

The problem posed thus consists of finding a simple and reliable means to permanently assure a constant viscosity for the reheated blank, which will be introduced into the injection molding machine or forging press, by affecting the regulation of the reheating.

Various solutions have been proposed to assure this regulation.

a) In the article "Manufacture of Automotive Components by Pressure Die Casting in Semi Liquid State," published in *Die Casting World*, October 1992, R. Moschini describes a process which consists of directly measuring the temperature of the blank for the few seconds during which it is transferred from the reheating furnace to the injection molding machine with the aid of a fast-reading thermocouple connected to a manipulator. If the temperature measured is outside a pre-established range, the blank is rerouted in order to prevent its entering the machine at an inadequate temperature.

This method has various drawbacks, both in principle and in its practical application. On one hand, a constant temperature does not guarantee a constant viscosity; in fact, at a given temperature the liquid fraction can vary according to differences in the composition of an alloy within the same standardized specification. For example, in an aluminum alloy of the AlSi7Mg type (which corresponds to the designations A356 and A357 of the Aluminum Association of the USA), the silicon content can vary from 6.5 to 7.5%, which results in an appreciable variation of the liquid fraction at 577° C.

The degree of globularity of the primary phase of the metal can also vary from one batch to another, which at a constant liquid fraction results in a variation of the viscosity at a given temperature.

Finally, for alloys which have a substantial isothermal eutectic plateau, such as aluminum-silicon alloys, the measurement of the temperature does not provide any information on the molten eutectic fraction.

On the other hand, from the practical point of view, a temperature measurement of the surface and over the heart of a semi-solid metal material, repeated at a production rate of 60 to 100 cycles per hour, poses substantial problems due to dirt accumulation on the thermocouples and to the imprecision of infrared measurements.

b) The reheating temperature can also be regulated directly by controlling the power supplied to the furnace, which is easily achievable in induction furnaces. But here again, the variation in the rate of globularity of the primary phase and the variability of the chemical compositions within standardized specifications make it impossible to assure sufficient constancy of the viscosity of the reheated blank. Moreover, the losses of energy through convection can vary appreciably in the same installation as a function of local environmental conditions such as ambient temperature or air currents.

c) Finally, it has been proposed that the viscosity of the reheated blank be measured directly with the aid of a probe of the penetrometer type, like that described in the article by M. C. Flemings, R. G. Riek, and K. P. Young, "Rheocasting", *Materials Science and Engineering, Vol.* 25, 1976, pp. 103–117. This method, while it does not introduce a bias, nevertheless poses practical problems of application. At the rapid production rate, dirt very quickly accumulates on the probe, modifying its geometry and surface condition and thus distorting the measurement. On the other hand, the penetration of a foreign body into the reheated metal, by cutting or boring through the blank before it is shaped, can cause defects such as oxide inclusions and bubbles, which damage the quality of the articles produced.

SUMMARY OF THE INVENTION

The object of the invention is thus to avoid the drawbacks of the methods described above and to furnish a simple, effective, and reliable means for regulating the viscosity of the reheated blank by means of the reheating, which will result in a constant, reproducible quality for the articles produced.

The invention is therefor directed to a process for shaping metal materials in a semi-solid state, which includes:

the preparation of a blank of thixotropic metal material, which corresponds in weight to the metal used in each production cycle in making the articles;

the reheating of this blank in a semi-solid state until a liquid fraction proportion which corresponds to the viscosity desired for the shaping is attained; and the transfer of this blank to a forging press or pressure die casting machine;

characterized in that the viscosity of the blank is regulated at the desired value by means of a corresponding regulation of the reheating power at a magnitude associated with the resistance of the material to the forging stamp or to the injection plunger during the filling phase of the forging die or the cavity of the mold.

The parameter which controls the regulation of the reheating can be the back pressure measured on the forging stamp or the injection plunger or even, in the case of pressure die casting, the feeding speed of the injection plunger at a constant hydraulic setting of the press.

DETAILED DESCRIPTION OF THE INVENTION

In effect, during pressure die casting of an aluminumsilicon alloy of the AlSi7Mg type reheated to a liquid fraction of about 50%, applicants have observed that the flow pressure during the second phase corresponding to the filling of the cavity of the mold was, completely unexpectedly, between 30 and 80 MPa, that is, much higher than that anticipated in theory or by the theoretical measurements of viscosity described for example in the aforementioned thesis by W. Loue, which indicates pressures on the order of 0.001 to 0.1 MPa.

Applicants have also observed that, when the viscosity of the reheated material varied from one production cycle to another, either because of a variation in the liquid fraction due to the instability of the reheating, or to a different degree of globularity in the solid phase, the filling pressure varied.

Finally, by using a traditional pressure die casting machine, whose injection cycle is not controlled in a closed loop, applicants have observed that, at a constant setting for the admission of oil into the motor ram, the increase in pressure necessary for the filling translated into a slowing of the feeding speed of the plunger. In this case, the thixoshaping device includes:

a furnace for reheating by induction, which includes two zones whose power levels can be regulated separately;

a robot which takes the reheated blank and transfers it into the container of the pressure die casting machine;

a pressure die casting machine with a conventional injection system, a setting for the admission of oil to the motor ram expressed as a percentage of the maximum being fixed a priori, and the speed of the plunger and the back pressure exerted by the metal during its injection, called the filling pressure, being determined a posteriori.

a microcomputer, which receives the values of the plunger speed and the filling pressure from the pressure die casting machine, and uses this information in software which controls the heating power in the two zones of the reheating furnace. The principle of the regulation software consists of comparing the measured value of the plunger speed to a set point value which corresponds to a speed which was chosen as having given satisfactory results during the development stage of the casting. The heating power levels are increased or decreased in successive increments, of 3% for example, until the set point has been passed, then in smaller increments, of 1% for example, in order to reach this set point.

EXAMPLE

The manufacture of an automobile engine part was developed using a batch of billets made of a thixotropic aluminum alloy of the A1Si7Mg type in a pressure die casting machine under a closing pressure of 750 metric tons and in a reheating furnace which included two reheating zones with 4 and 8 inductors, respectively. The blank stays in the first zone for 328 sec and in the second zone for 654 sec. The set point values retained were:

setting for the delivery of oil to the motor ram: a maximum of 90% speed of the plunger: 0.60 m/sec filling pressure: 32 MPa

With the batch of billets used in the development stage, the heating setting which made it possible to obtain the set point values for the plunger speed and the filling pressure was:

in the first zone: 47.4 kW in the second zone: 15.5 kW

When a second, different batch of thixotropic billets was used, it was observed that, without a change in the setting, the injection parameters became:

speed of the plunger: 0.51 m/s filling pressure: 40 MPa, which indicated a higher apparent viscosity of the material.

Regulation of the reheating system was thus implemented by using the regulation of the plunger speed as a parameter, with the filling pressure simply being recorded. The program reached the following setting of the heating power levels:

first zone: 53.2 kW (+11%)

second zone: 16.6 kW (+7%)

With this reheating setting, injection parameters which were practically identical to the set point values were regained:

speed of the plunger: 0.60 m/sec filling pressure: 31.8 MPa

It was also observed that not only did the plunger speed return to the set point value used for the regulation, but the filling pressure also regained its initial set point. This clearly shows that the apparent viscosity of the blanks derived from the second batch of billets was rendered equal to that of the blanks derived from the first batch.

What is claimed is:

1. A process for shaping metal materials in a semi-solid state comprising:

a) preparing a blank of a thixotropic metal material which corresponds in weight to metal material to be used in each production cycle in making a series of articles;

b) reheating the blank to a semi-solid state to obtain a liquid fraction corresponding to a predetermined viscosity desired for said shaping, while determining power used in said reheating;

c) transferring the reheated blank to a forging press including a forging stamp or to a pressure die casting machine including an injection plunger;

d) determining the resistance of the material to the forging stamp or injection plunger, said resistance being defined as a set point value;

e) shaping the blank by means of forging or pressure die casting;

f) preparing a subsequent blank of said thixotropic metal material, reheating said subsequent blank to a semi-solid state, transferring said reheated subsequent blank to said forging press or pressure die casting machine, measuring resistance of the material to the forging stamp or injection plunger and shaping said subsequent blank; and g) regulating the power used in reheating said subsequent blank to maintain said resistance at said set point value.

2. The process according to claim 1, wherein the resistance determined is back pressure measured on the forging stamp or the injection plunger.

3. The process according to claim 1, wherein the resistance determined is speed of the injection plunger at a constant hydraulic setting.

4. The process according to claim 1, wherein said pressure die casting machine includes preprogrammed automatic control of injection speed and the resistance determined is a hydraulic setting for the machine.

5. A process for shaping an aluminum alloy in a semi-solid state comprising:

a) preparing a blank of a thixotropic aluminum alloy material which corresponds in weight to the aluminum alloy to be used in each production cycle in making a series of articles;

b) reheating the blank to a semi-solid state to obtain a liquid fraction corresponding to a predetermined viscosity desired for said shaping, while determining power used in said reheating;

c) transferring the reheated blank to a forging press including a forging stamp or to a pressure die casting machine including an injection plunger;

d) determining the resistance of the material to the forging stamp or injection plunger, said resistance being defined as a set point value;

e) shaping the blank by means of forging or pressure die casting;

f) preparing a subsequent blank of said thixotropic aluminum alloy material, reheating said subsequent blank to a semi-solid state, transferring said reheated subsequent blank to said forging press or pressure die casting machine, measuring resistance of the material to the forging stamp or injection plunger and shaping said subsequent blank; and g) regulating the power used in reheating said subsequent blank to maintain said resistance at said set point value.

6. The process according to claim 5, wherein the resistance determined is back pressure measured on the forging stamp or the injection plunger.

7. The process according to claim 5, wherein the resistance determined is speed of the injection plunger at a constant hydraulic setting.

8. The process according to claim 5, wherein said pressure die casting machine includes preprogrammed automatic control of injection speed and the resistance determined is a hydraulic setting for the machine.

* * * * *